US007874303B2

(12) United States Patent
Xie

(10) Patent No.: US 7,874,303 B2
(45) Date of Patent: Jan. 25, 2011

(54) SLIDING DEVICE USED ON THE SUPPORTING SHAFT

(75) Inventor: Wencang Xie, 9F, Hongxiang Building, No. 258, South Hubin Road, Siming District, Xiamen City, Fujian 361000 (CN)

(73) Assignees: Wencang Xie, Xiamen (CN); China National Aero-Technology Import & Export Xiamen Corporation, Xiamen (CN)

( * ) Notice: Subject to any disclaimer, the term of this patent is extended or adjusted under 35 U.S.C. 154(b) by 9 days.

(21) Appl. No.: 12/364,782

(22) Filed: Feb. 3, 2009

(65) Prior Publication Data

US 2009/0255564 A1 Oct. 15, 2009

(30) Foreign Application Priority Data

Apr. 14, 2008 (CN) ..... 2008 2 0101963 U
Sep. 18, 2008 (CN) ..... 2008 2 0145619 U

(51) Int. Cl.
*E04H 15/32* (2006.01)
*F16B 7/14* (2006.01)

(52) U.S. Cl. ..... 135/120.3; 135/140; 135/142; 403/377; 403/109.3; 403/322.4; 248/125.8

(58) Field of Classification Search ..... 135/121, 135/139–145, 117, 120.3, 114; 403/377, 403/378, 400, 109.3, 109.6, 175, 322.4; 16/644; 248/125.8, 219.3, 220.1, 231.5, 231.51
See application file for complete search history.

(56) References Cited

U.S. PATENT DOCUMENTS

| | | | | |
|---|---|---|---|---|
| 4,185,936 | A * | 1/1980 | Takahashi | 403/104 |
| 6,079,431 | A * | 6/2000 | Su | 135/72 |
| 6,082,680 | A * | 7/2000 | Woodward et al. | 248/682 |
| 6,347,777 | B1 * | 2/2002 | Webber et al. | 248/354.1 |
| 6,508,262 | B1 | 1/2003 | Takayama | |
| 6,575,656 | B2 * | 6/2003 | Suh | 403/109.6 |
| 7,040,832 | B2 * | 5/2006 | Hsieh | 403/109.3 |
| 7,097,380 | B2 * | 8/2006 | Lee | 403/109.2 |
| 7,293,934 | B1 * | 11/2007 | Huang | 403/109.1 |
| 7,395,830 | B2 * | 7/2008 | Seo | 135/140 |
| 7,409,963 | B2 * | 8/2008 | Mallookis et al. | 135/144 |
| RE40,657 | E * | 3/2009 | Suh | 403/109.3 |
| 2006/0062632 | A1 * | 3/2006 | Jang | 403/109.6 |

FOREIGN PATENT DOCUMENTS

| | | |
|---|---|---|
| CN | 2697221 Y | 5/2005 |
| CN | 201043365 Y | 4/2008 |

* cited by examiner

*Primary Examiner*—Winnie Yip
(74) *Attorney, Agent, or Firm*—Rabin & Berdo, P.C.

(57) ABSTRACT

The present invention discloses a sliding device used on the supporting shaft, which utilizes the button to achieve single-handed operation, utilizes horizontal slide of the bolt to achieve the steady locking of tiny clearance, and utilizes the active connection with relative turn and relative slide between the sliding base and the button to achieve transmission between the pressing of users and the horizontal slide of the bolt.

6 Claims, 7 Drawing Sheets

SLIDING DEVICE USED ON THE SUPPORTING SHAFT

FIELD OF THE INVENTION

The present invention relates to a sliding device used on the supporting shaft, particularly to a sliding device used on the supporting shaft of the folding tent.

RELATED ART

The supporting shaft of the tent generally has a sliding device for connecting to other parts of the tent. The supporting shaft can be supporting leg for supporting the tent or top supporting shaft at the center of the top of the tent. The supporting shaft is generally pipe piece and has a locking hole through inside and outside. Early sliding device comprises a sliding base, a bolt, an elastic body and a pull ring. The sliding base has a sliding through hole and a mounting hole through inside and outside, and the sliding through hole is covered on the supporting shaft, and the mounting hole and the sliding through hole are orthogonal and connected to each other. The bolt is installed in the mounting hole and slides between a first position and a second position; at the first position the bolt is inserted into the sliding through hole and inserted into the locking hole; at the second position the bolt is withdrew into the mounting hole and the sliding base can slide freely. The elastic body is connected to the bolt and the sliding base and has an elasticity that can make the bolt be pushed and keep at the first position. The pull ring is connected to the outer end that the bolt bassets outside of the mounting hole. The sliding device can be seen in the patent U.S. Pat. No. 6,508,262B1 with a title of folding tent frame that is published at Jan. 21, 2003. The sliding device has disadvantages as follows: in using users must pull the pull ring to overcome the elasticity of the elastic body to make the bolt get out of the locking hole and the sliding base can slide freely with one hand and fasten the sliding base to make the sliding base slide against the supporting shaft with the other hand, which must be handled with two hands, to make it be inconvenient for using.

Aiming at above disadvantages, people give a settling solution: a sliding device comprises a sliding base, a bolt, an elastic body and a button. The sliding base has a sliding through hole and a mounting hole through inside and outside, and the sliding through hole is covered on the supporting shaft, and the mounting hole and the sliding through hole are orthogonal and connected to each other. The bolt is installed in the mounting hole and moves between a first position and a second position; at the first position the bolt is inserted into the sliding through hole and inserted into the locking hole; at the second position the bolt is withdrew into the mounting hole and the sliding base can slide freely. The button comprises a middle part, a pull part that is in front of the middle part and a button part that is in back of the middle part; the middle part is pivoted to the sliding base, the pull part is pivoted to the bolt, and the button part is used for pressing for users. The elastic body is installed between the backside of the button part and the sliding base. In using users handhold the sliding base with one hand and press the button with fingers of the hand, which overcomes the elasticity of the elastic body, to drive the button turn relatively to axes, to drive the pull part turn around axes, to drive the outer end of the bolt turn outward relatively to axes, to drive the bolt get out of the locking hole to make the sliding base slide freely. Here the hand that handholds the sliding base can drive the sliding base slide along the supporting shaft. The sliding device can be seen in Chinese patent NO. ZL200420014929.1 and ZL200720006655.5. Although the sliding device settles above disadvantages, uses can complete operation with one hand, it also has following disadvantages as follows:

Firstly, as a result of that the movement track of the pull part of the bolt is circular arc, the movement track of the bolt is not a simple aclinic movement but a complicated curve track. So the aperture of the locking hole must be bigger than the outside diameter of the bolt, which makes locking of the sliding base be unsteadily. Even at the state of locking the sliding base can slide along the supporting shaft in some sort, and the sliding distance is diameter difference of the aperture of the locking hole and the outside diameter of the bolt. The bolt also has a complicated inserting track, which is not inconvenient for inserting and can bring blocking phenomena.

Secondly, the elastic body is installed between the backside of the button part and the sliding base. Because there is no orientation shaft for being covered for the elastic body, so the elastic body cannot be fastened. In setting the elastic body twists easily to result in that it is inconvenient for using and has a short life. Even there is orientation shaft, but because the orientation shaft also has a complicated movement curve, so the elastic body will also twist in compressing or elongate.

Thirdly, spring is set on the button part, in normal state the spring drives the button firstly, then the button drive the bolt to ensure that the bolt is at the first position, which has a bad orientation effect. Besides, in pressing the button the users press the spring directly. As a result of that different users have different strength, the spring is easily destroyed and loses its elasticity and its locking function.

SUMMARY OF THE INVENTION

The present invention provides a sliding device used on the supporting shaft, which overcomes the disadvantages of inconvenient using and unstable locking that the sliding devices have in the related art.

The present invention adopts technical solution as follows.

A sliding device used on the supporting shaft, which is installed on the supporting shaft with locking hole slidably, comprising a sliding base having a sliding through hole and a mounting hole; the sliding through hole is covered on the supporting shaft slidably; the mounting hole and the sliding through hole are orthogonal and connected to each other;

a bolt that is installed in the mounting hole and can slide between a first position and a second position; at the first position the bolt is inserted into the sliding through hole and the locking hole; at the second position the bolt is withdrew into the mounting hole;

an elastic body that is connected to the bolt and the sliding base has an elasticity that can make the bolt be pushed and keep at the first position; and a button that is installed on the sliding base and can form an active connection with relative turn and relative slide with the sliding base; the button has a pull part that is pivoted to the bolt and a button part for pressing of users.

According to a preferred embodiment of the present invention, the sliding base protrudes to form a back wall; the button part is set on the button protuberantly and has a button face, which is parallel to the supporting shaft and is level to the bottom face of the back wall when the button face is pressed to the end.

According to a preferred embodiment of the present invention, the mounting hole is ladder-shaped hole with an outer big hole and an inner small hole through inside and outside. The bolt has an inner end part that is matched with the locking hole and the inner small hole and an outer end part that is pivoted to the pull part of the button.

According to a preferred embodiment of the present invention, the sliding base has a mounting slot; the button has an orientation spindle; the orientation spindle is installed in the mounting slot and forms an active connection with relative turn and relative slide with the mounting slot.

According to a preferred embodiment of the present invention, the inside diameter of the mounting slot is bigger than the outside diameter of the orientation spindle.

According to a preferred embodiment of the present invention, the mounting slot is kidney-shaped slot; the orientation spindle can turn and slide in the mounting slot.

According to a preferred embodiment of the present invention, the middle part of the button protrudes upwards and downwards to form raised spindles, namely the orientation spindle. The pull part is set in front of the raised spindles and the button is set in back of the raised spindles.

According to a preferred embodiment of the present invention, the mounting slot has an airward mouth or a backward mouth; the size of the mouth is smaller than the outside diameter of the orientation shaft.

According to a preferred embodiment of the present invention, the middle part of the bolt protrudes outside to form a raised ring; there is an orientation sleeve in the outer big hole of the mounting hole of the sliding base; the outer end of the orientation sleeve protrudes inwards to form a ringed lid; the outer end part of the bolt gets out of the ringed lid and is pivoted to the pull part of the button. The elastic body is a spring, and it covers the bolt and pushes the raised ring and the ringed lid.

According to a preferred embodiment of the present invention, the sliding base has a mounting slot. The button gets through the mounting slot. The clearance of the mounting slot is bigger than the thickness of the button.

Comparing with the related art and aiming at the disadvantages of the related art, the present applicant invents a new technical solution, which utilizes the button to achieve single-handed operation, utilizes horizontal slide of the bolt to achieve the steady locking of tiny clearance(this tiny clearance is smaller than the clearance in the related art), utilizes the active connection with relative turn and relative slide between the sliding base and the button to achieve transmission between the pressing of users and the horizontal slide of the bolt. The button face is parallel to the supporting shaft when it is pressed to the end, which is convenient for users controlling pressing limit to avoid excess pressing and prolongs useful life. The inner end part of the bolt is matched with the locking hole and the inner small hole to achieve match of tiny clearance. The spring is covered on the bolt directly, so when the bolt is at the first position, the spring acts on the bolt directly, which has a good security. In pressing the button it needs not acting on the spring directly, but pulls the bolt by the button; the horizontal slide of the bolt acts on the spring to make the spring be pressed, so the spring is not destroyed easily and has a long useful life to ensure that the bolt has a good locking effect.

BRIEF DESCRIPTION OF THE DRAWINGS

The present invention will be further described according to the drawings and the embodiments.

DETAILED DESCRIPTION OF THE PREFERRED EMBODIMENTS

Figure 1:
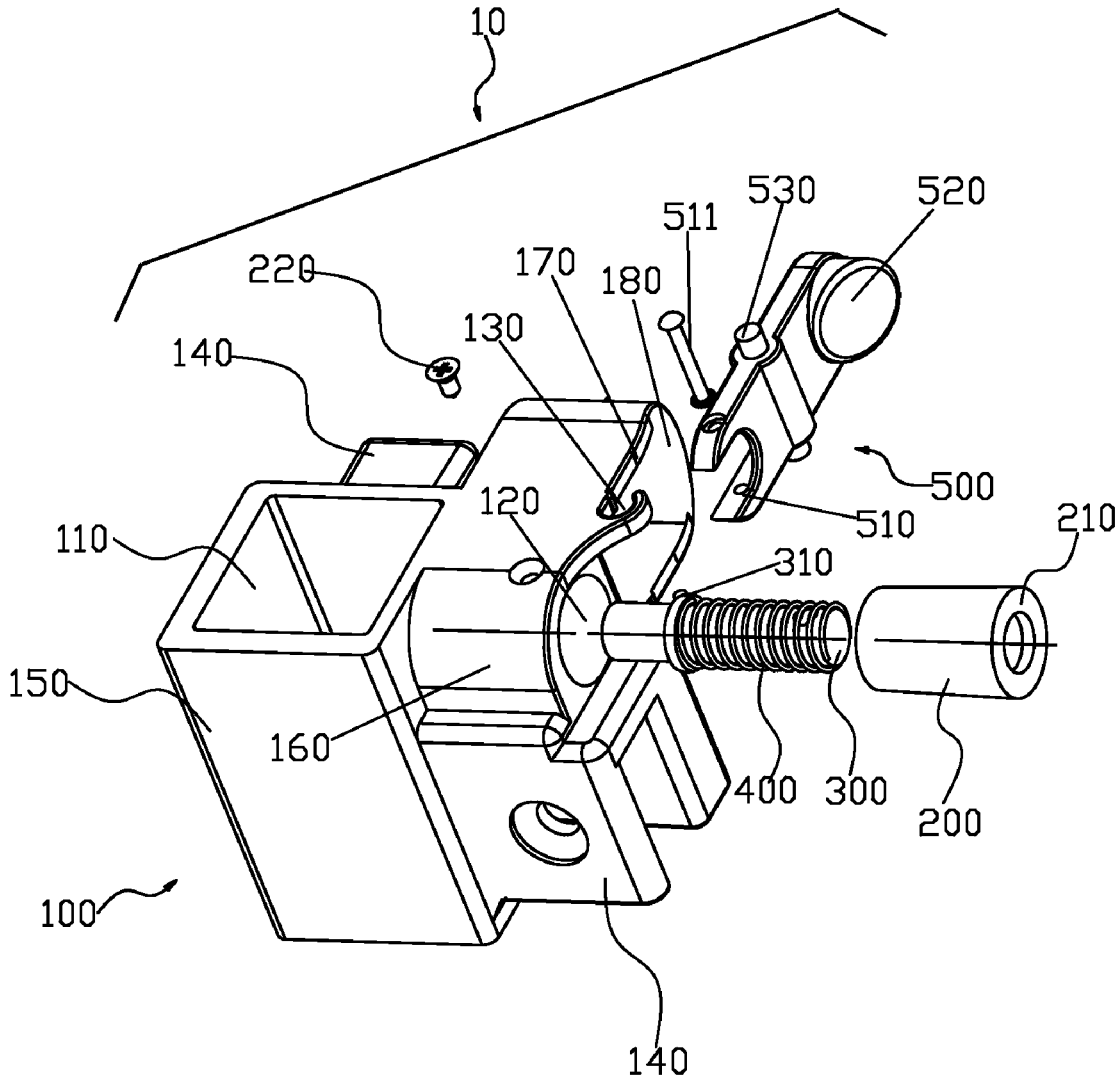
FIG. 1 is an exploded view according to a preferred embodiment of the sliding device of the present invention.
Figure 2:
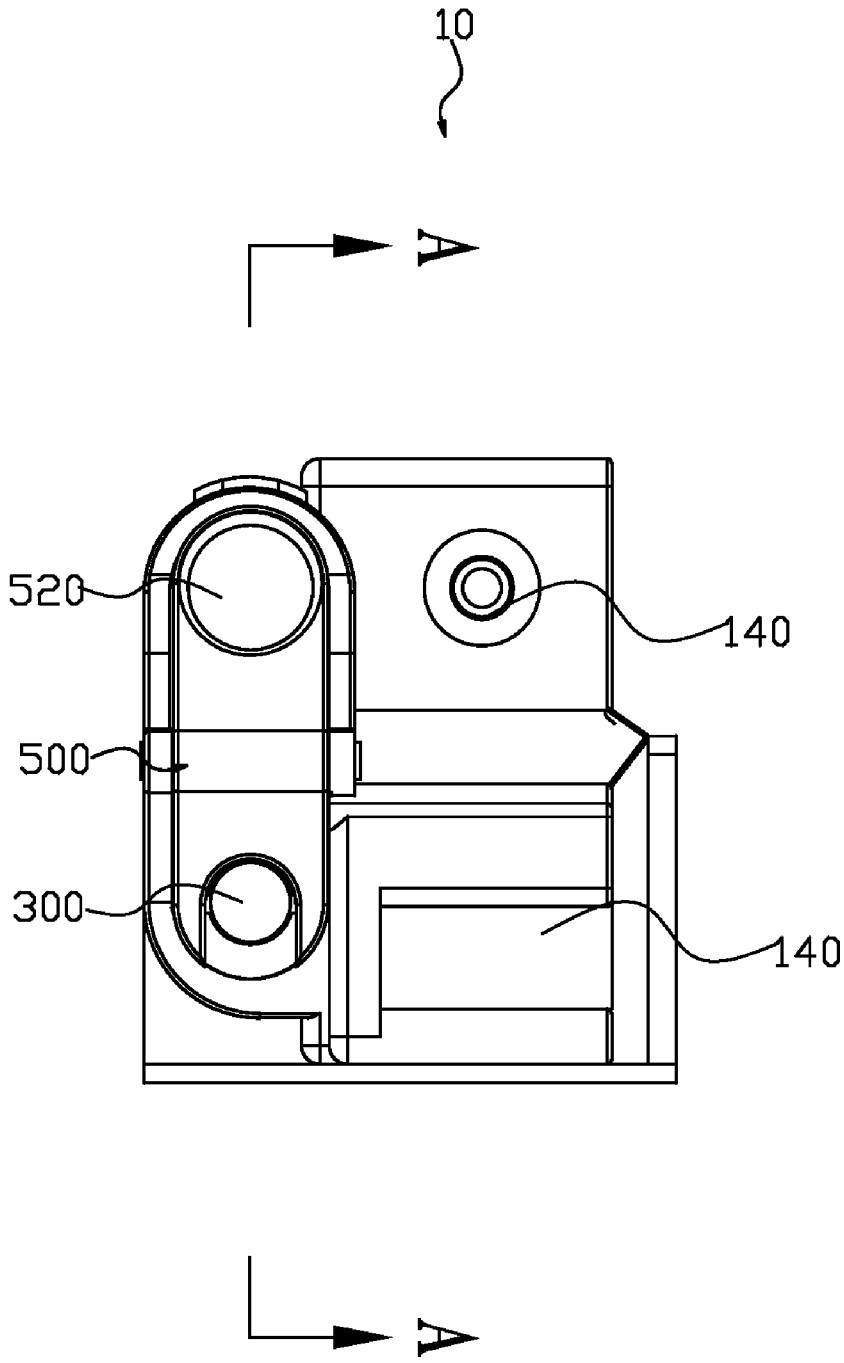
FIG. 2 is a front view according to a preferred embodiment of the sliding device of the present invention.

A sliding device 10 is disposed on the supporting leg of the tent slidably. The sliding device 10 is used to being connected to the forficiform connecting rod of the tent. The supporting leg is pipe piece and has a locking hole through inside and outside. In the present invention, the sliding device 10 is not only fit for the supporting leg of the tent, but also fit for the top supporting shaft at the center of the top of the tent, and so on.

Embodiment 1

Referring to FIGS. 1 to 4, the sliding device 10 comprises a sliding base 100, an orientation sleeve 200, a bolt 300, an elastic body 400 and a button 500.

The sliding base 100 comprises a sliding through hole 110 through upside and downside, a main sleeve 150 encircling the sliding through hole 110, a horizontal mounting hole 120 through inside and outside, a side sleeve 160 encircling the mounting hole 120 and fixed to a side of the main sleeve 150, at least two connecting parts 140 that are fixed to the outside of the main sleeve 150 and are used to being connected to the forficiform connecting rod, two disjunct basal walls 170 that are fixed to sides of the main sleeve 150 and beside the side sleeve 160, and a back wall 180 that is fixed to the two basal walls 170. Wherein the sliding through hole 110 is fittingly covered on the supporting shaft slidably to make the sliding base 100 and the supporting shaft form a sliding connection up and down. The mounting hole 120 and the sliding through hole 100 are orthogonal and connected to each other. The mounting hole 120 is designed to be ladder-shaped hole with an outer big hole and an inner small hole. The inside diameter of the inner small hole is matched with the inside diameter of the locking hole. An end side of the basal wall 170 has a mounting slot 130 with a backward mouth. There is a position space among the side sleeve 160, the basal wall 170 and the back wall 180.

The orientation sleeve 200 is fixedly disposed in the outer big hole of the mounting hole 120. The outside diameter of the orientation sleeve 200 is matched with the inside diameter of the outer big hole of the mounting hole 120 to ensure that fixed connection between the orientation sleeve 200 and the mounting hole 120, and there is a bolt 220 for locking the mounting hole and the orientation sleeve. The outer end of the orientation sleeve 200 protrudes inwards to form a ringed lid 210.

Figure 3:
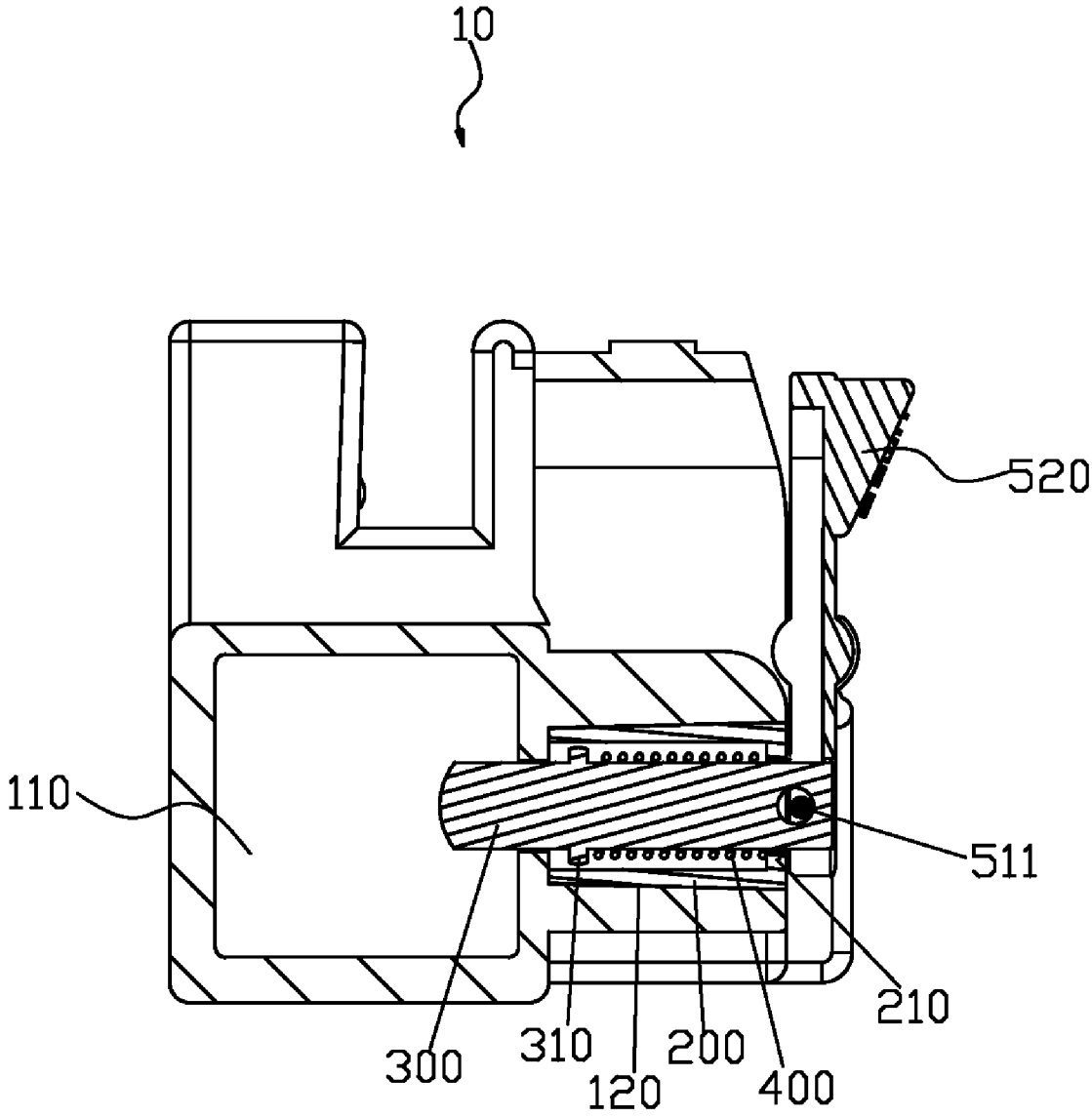
FIG. 3 is an A-A cut-open view of the sliding device in the FIG. 2; here the sliding device is in locking state.
Figure 4:
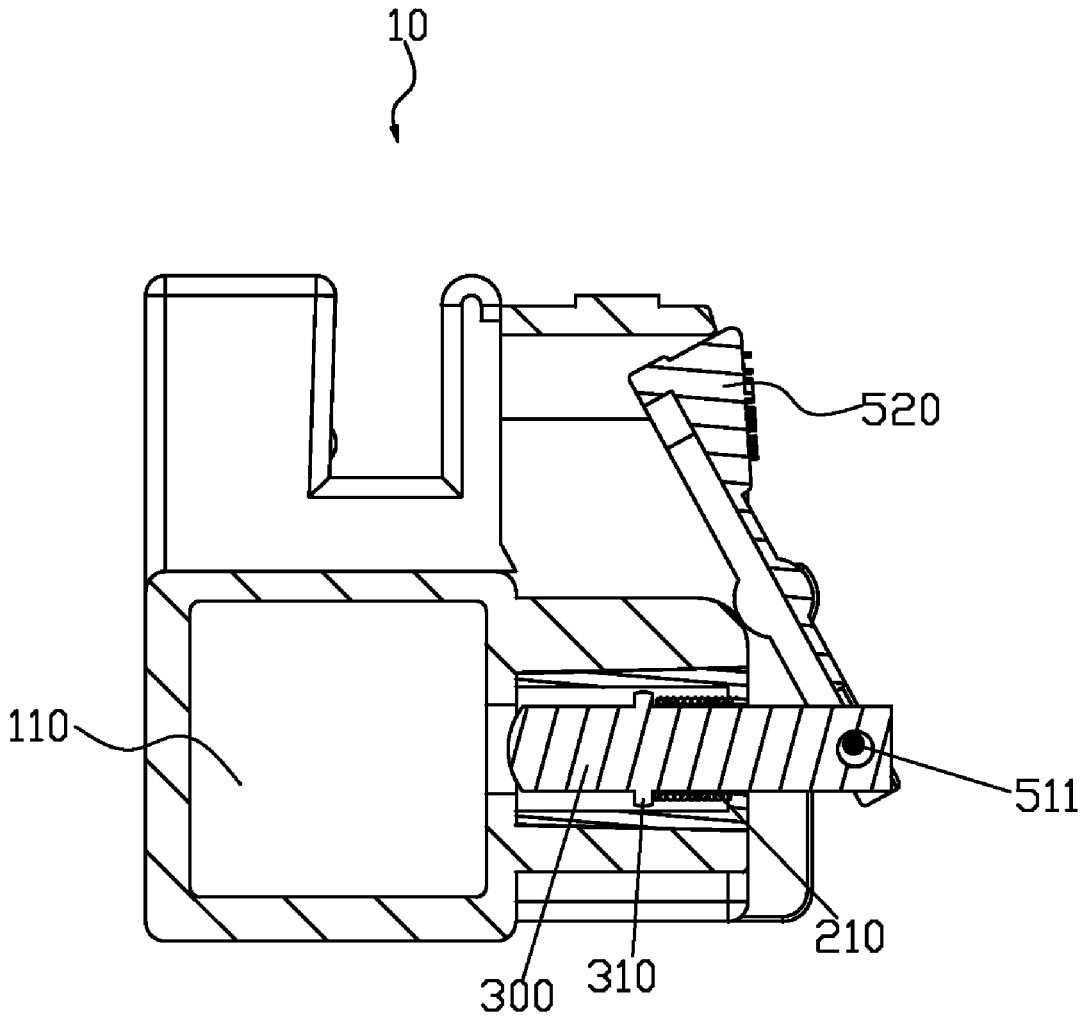
FIG. 4 is an A-A cut-open view of the sliding device in the FIG. 2; here the sliding device is in release state.

The bolt 300 has an inner end part, an outer end part and a middle part between the inner end part and the outer end part. The inner end part of the bolt 300 is matched with the locking hole of the supporting shaft and the inner small hole of the mounting hole 120, and the end face of the inner end part is designed to be hemispheroidal face or coniform face. A middle of the middle part protrudes outside to form a raised ring 310 for being connected to the elastic body 400. The bolt 300 is installed in the mounting hole 120 and can slide between a first position and a second position. At the first position the inner end part of the bolt 300 is pushed into the sliding through hole 110 and inserted into the locking hole of the supporting shaft to achieve locking, as shown in FIG. 3. At the second position the bolt 300 is withdrew into the mounting hole 120 to achieve release, as shown in FIG. 4. The outer end part of the bolt 300 gets out of the ringed lid 210 of the orientation sleeve 200, and the raised part 310 is disposed in the outer big hole of the mounting hole 120 and the orientation sleeve 200.

The elastic body 400 is a reposition spring, and it covers the bolt 300 and pushes the raised ring 310 of the bolt 300 and the ringed lid 210 of the orientation sleeve 200 and has an elasticity that can make the bolt 300 be pushed and keep at the first position.

The button 500 comprises a middle part, a pull part 510 that is disposed in front of the middle part and a button part 520 that is disposed in back of the middle part. The middle part of the button protrudes upwards and downwards to form two symmetrical raised spindles 530. The two raised spindles 530 are disposed in the two mounting slots 130 respectively. The inside diameter of the mounting slot 130 is bigger than the outside diameter of the raised spindles 530 to make the raised spindles 530 can slide and turn relatively to the mounting slot 130, and to make the button 500 and sliding base 100 can form an active connection with relative turn and relative slide, and to achieve needed movement track. The pull part 510 is furcated part, which covers the outer end part that the bolt 300 protrudes outside of the ringed lid 210, and there is a rivet 511 to get through the pull part 510 and the outer end part, to make the pull part 510 and the outer end part of the bolt 300 form a pivot connection. The button part 520 is set on the surface of button 500 protuberantly and in front of the back wall 180 to make the button part 520 be positioned in the position space, and the button face of the button part 520 is a gradient face with a low front part and a high back part.

When users press the button part 520, the pull part 510 of the button 500 slides outwards horizontally to drive the inner end part of the bolt 300 being withdrawn into the mounting hole 120 to achieve release. Here the raised spindles 530 and the mounting slot 130 form an active connection with simultaneous turn and slide for cooperating with the horizontal outward slide trace of the pull part.

If needed, the gradient angle of the button face of the button part 520 and the height of the back wall 180 can be designed to satisfy when the button face is pressed to the end, the button face is just horizontal to the supporting shaft and the end face of the back wall 180, which can avoid excess press and prolong useful life.

If needed, the mouth of the mounting slot 130 can be slightly smaller than the outside diameter of the raised spindle 530. In assembling the raised spindle 530 can be assembled into the mounting slot 130 easily because the mouth has elasticity. When the assembly is completed, the elasticity of the mouth can prevent the raised spindles getting out of the mounting slot, which is convenient for assembly and can enhance connection intension of accessories.

The mounting slot is kidney-shaped slot. The orientation spindle can turn and slide in the mounting slot synchronously to achieve the active connection with relative turn and relative slide between the button and the sliding base.

Embodiment 2

Figure 5:
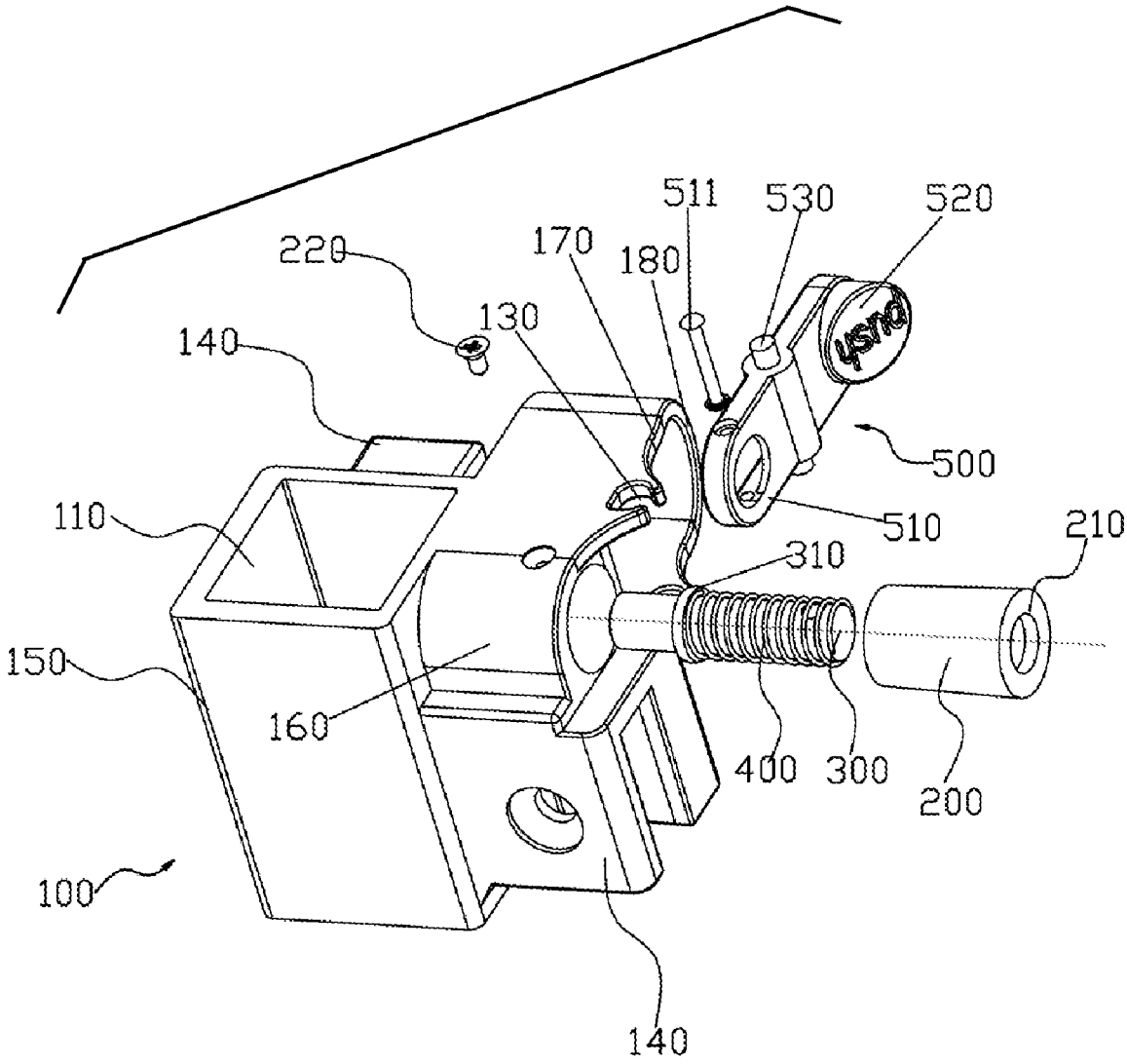
FIG. 5 is an exploded view according to another preferred embodiment of the sliding device of the present invention.

Referring to FIG. 5, the mounting slot 130 has an upward mouth. The pull part 510 is a ring, which covers the outer end part that the bolt 300 protrudes outside of the ringed lid 210, and there is a rivet 511 to get through the pull part 510 and the outer end part.

Embodiment 3

Figure 6:
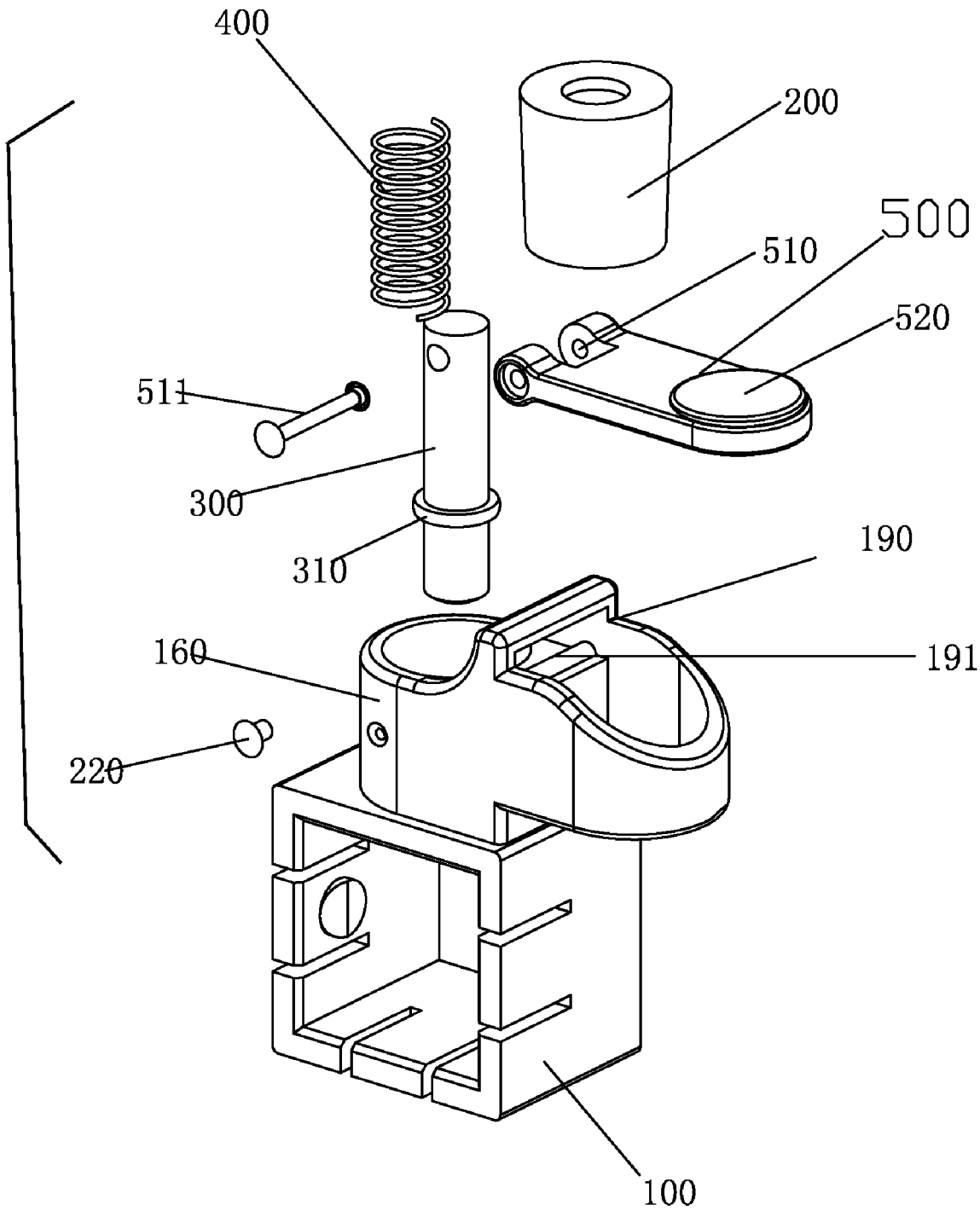
FIG. 6 is an exploded view according to another preferred embodiment of the sliding device of the present invention.
Figure 7:
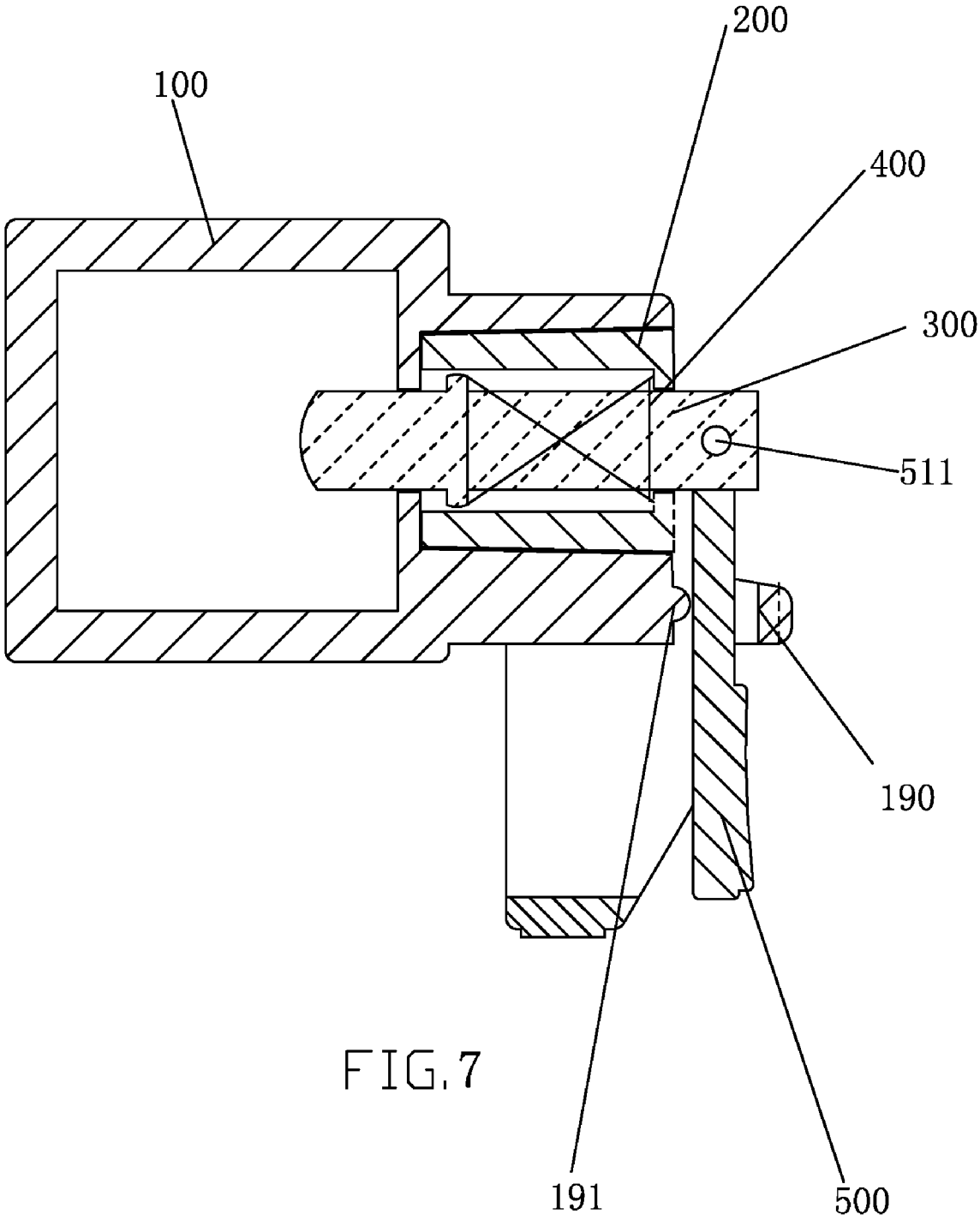
FIG. 7 is a cut-open view of the FIG. 6.

Referring to FIGS. 6 and 7,the present embodiment has differences with the embodiment 1 as follows: Installation modes of the button 500 and the sliding base 100 are different. The upside of the sliding base 100 has a mounting slot 190 that the button 500 can get through. The mounting slot 190 has a raised platform 191. The clearance of the mounting slot 190 is bigger than the thickness of the button 500 to make the button 500 and the sliding base 100 form an active connection with relative turn and relative slide synchronously.

In normal state, the bolt 300 is at a first position at the effect of the spring 400; here the bolt 300 is inserted into the locking hole of the supporting shaft to be fixed to the first position. When the bolt 300 is needed to be withdrew, the button 500 is pressed, and the pull part of the button pulls the button 300 upwards utilizing a pivot namely the raised platform 191 of the mounting slot 190 to make the bolt 300 being positioned to a second position; here the bolt 300 gets out of the locking hole of the supporting shaft. Because just the pull part of the button 500 and the bolt 300 form a hinge joint; there is only position limit but no fixed connection, so the button 500 and sliding base 100 form an active connection with simultaneous turn and slide at the raised platform 191 for cooperating with the horizontal outward slide trace of the pull part to ensure that the bolt 300 has a linear movement.

INDUSTRY PRACTICABILITY

The sliding device used on the supporting shaft of the present invention utilizes the button to achieve singlehanded operation, utilizes horizontal slide of the bolt to achieve the steady locking of tiny clearance, utilizes the active connection with relative turn and relative slide between the sliding base and the button to achieve transmission between the pressing of users and the horizontal slide of the bolt. The present invention has a simple structure, is used expediently and has a good industry practicability.

What is claimed is:

1. A sliding device slidably installable on a supporting shaft, the supporting shaft having a locking hole, comprising:

a sliding base having a mounting hole, and a sliding through hole slidably positionable over the supporting shaft, the mounting hole and the sliding through hole being orthogonal and connected to each other;

a bolt installed in the mounting hole and being slidable between a first position in which the bolt is inserted into the sliding through hole and the locking hole, and a second position in which the bolt is withdrawn from the sliding through hole and the locking hole;

an elastic body that is connected to the bolt and the sliding base, and urging the bolt to maintain the bolt at the first position; and a button installed on the sliding base and forming an active connection that is both slidable and turnable relative to the sliding base, the button having a pull part that is pivoted to the bolt and a button part for pressing by a user;

wherein the sliding base has a mounting slot;

the button entends through the mounting slot; and a clearance of the mounting slot is bigger than a thickness of the button.

2. The sliding device used according to claim 1, wherein the mounting slot of the sliding base has a raised platform; and the button and sliding base form the active connection at the raised platform to ensure that the bolt has a linear movement.

3. A sliding device slidably installable on a supporting shaft, the supporting shaft having a locking hole, comprising:

a sliding base having a mounting hole, and a sliding through hole slidably positionable over the supporting shaft, the mounting hole and the sliding through hole being orthogonal and connected to each other, the sliding base further having a protruding back wall;

a bolt installed in the mounting hole and being slidable between a first position in which the bolt is inserted into the sliding through hole and the locking hole, and a second position in which the bolt is withdrawn from the sliding through hole and the locking hole;

an elastic body that is connected to the bolt and the sliding base, and urging the bolt to maintain the bolt at the first position; and a button installed on the sliding base and forming an active connection that is both slidable and turnable relative to the sliding base, the button having a pull part that is pivoted to the bolt and a button part for pressing by a user, the button part having a protruding button face that is level with a bottom face of the back wall when the button face is pressed;

wherein the sliding base has a mounting slot;

the button extends through the mounting slot; and a clearance of the mounting slot is bigger than a thickness of the button.

4. The sliding device according to claim 3, wherein the mounting slot of the sliding base has a raised platform; and the button and sliding base form the active connection at the raised platform to ensure that the bolt has a linear movement.

5. A sliding device slidably installable on a supporting shaft, the supporting shaft having a locking hole, comprising:

a sliding base having a ladder-shaped mounting hole, and a sliding through hole slidably positionable over the supporting shaft, the mounting hole and the sliding through hole being orthogonal and connected to each other, the mounting hole having an inner small hole and an outer large hole;

a bolt installed in the mounting hole and being slidable between a first position in which an inner end of the bolt is inserted into the inner small hole, the sliding through hole and the locking hole, and a second position in which the inner end of the bolt is withdrawn from the sliding through hole and the locking hole;

an elastic body that is connected to the bolt and the sliding base, and urging the bolt to maintain the bolt at the first position; and a button installed on the sliding base and forming an active connection that is both slidable and turnable relative to the sliding base, the button having a pull part that is pivoted to an outer end of the bolt and a button part for pressing by a user;

wherein the sliding base has a mounting slot;

the button extends through the mounting slot; and a clearance of the mounting slot is bigger than a thickness of the button.

6. The sliding device according to claim 5, wherein the mounting slot of the sliding base has a raised platform; and the button and sliding base form the active connection at the raised platform to ensure that the bolt has a linear movement.

* * * * *